United States Patent [19]

Smith

[11] Patent Number: 4,691,863

[45] Date of Patent: Sep. 8, 1987

[54] RAILROAD GRADE CROSSING STRUCTURE

[76] Inventor: Gene M. Smith, 4602 Beauchamp Rd., Plant City, Fla. 33566

[21] Appl. No.: 863,687

[22] Filed: May 15, 1986

[51] Int. Cl.[4] ..... E01B 2/00

[52] U.S. Cl. ..... 238/8

[58] Field of Search ..... 238/8, 1, 3, 4, 9

[56] References Cited

U.S. PATENT DOCUMENTS

| | | | |
|---|---|---|---|
| 1,130,997 | 3/1915 | Newhall | 238/9 |
| 1,195,402 | 8/1916 | Rust | 238/8 |
| 1,758,935 | 5/1930 | Dailey et al. . | |
| 2,835,451 | 5/1958 | Goudling, Jr. | 238/8 |
| 2,839,249 | 6/1958 | Curtis | 238/8 |
| 3,113,722 | 12/1963 | Kocher | 238/9 |
| 3,353,747 | 11/1967 | Speer | 238/8 |
| 3,517,882 | 6/1970 | Hooper | 238/8 |
| 3,861,591 | 1/1975 | Rector | 238/8 |
| 4,253,605 | 3/1981 | Sims | 238/8 |
| 4,267,969 | 5/1981 | Hales et al. | 238/8 |
| 4,545,527 | 10/1985 | Young | 238/8 |

FOREIGN PATENT DOCUMENTS 449178 9/1927 Fed. Rep. of Germany ..... 238/8

*Primary Examiner*—David A. Scherbel
*Assistant Examiner*—Scott H. Werny
*Attorney, Agent, or Firm*—Pettis & McDonald

[57] ABSTRACT

A railroad grade crossing structure includes rail support plates interposed between the rails and the crossties to which they are attached and extending laterally outwardly from the rail flanges, and decking structure having a generally Z-shaped cross section with upper and lower generally horizontal panels joined by connector panels with the lower panels engaging the railroad crossties and the upper panels having a support structure extending downwardly to and engaging the rail support plate, with thoroughfare paving material overlying the lower panel and filling the space between the upper surface of the lower panel and a plane generally parallel to the upper surface of the upper panel of the decking elements.

10 Claims, 5 Drawing Figures

RAILROAD GRADE CROSSING STRUCTURE

BACKGROUND OF THE INVENTION

This invention relates to the field of railroad grade crossings where highway or street thoroughfares cross railroad tracks.

Such crossing have long been a source of difficulty for maintenance of thoroughfares because of the discontinuity in paving that they necessarily require and the associated free standing structure filling the gap between each pair of rails. Numerous structures fabricated from wood, rubber and metal have been developed and installed to meet such needs. However, virtually all such structures have suffered from difficulty and expense of installation, limited useful life and expense and difficulty of replacement. When such replacement has been required, it creates additional problems for a busy thoroughfare where it is necessary to divert or block traffic while the crossing structure is replaced or repaired.

The difficulty in developing and installing simple crossing structures relates to the conflicting requirements for the railway and the roadway of the vehicular thoroughfare crossing the railway. Attachment of the crossing structure to the rails themselves is unsatisfactory for several reasons. First, the rails which run transverse to the roadway will necessarily undergo some deflection caused by the weight of train wheels passing along the rails. Such deflection is compensated for by the roadbed provided beneath the crossties to which the rails are attached. However, such flexing of the rails conflicts with the requirements of rigidity necessary for the thoroughfare. For this reason it is necessary that the grade crossing structure be supported by some means other than by direct contact with the rails. Additionally, connection of the grade crossing structure directly to the rails themselves would tend to transmit the heavy and frequent pounding caused by the passage of heavy trucks thereover directly to the rail, likely causing a fatiguing and possibly premature failure of the rails. This is one reason that such direct connection of the crossing structure to the rails themselves generally is not permitted.

A primary problem associated with the prior art grade crossing structures has been the difficulty of fixing the structures in place while still permitting reasonable capability for removal and replacement. The positioning has been especially difficult with respect to portions of the grade crossing structure that are immediately adjacent the rail. The problems have included the difficulty of maintaining the desired spacing of the grade crossing decking from the rail to accommodate the flanges of the train wheels, the minimizing of that gap in order to provide the smoothest surface possible for vehicular traffic and avoidance of such gap becoming filled with foreign objects, thus creating a risk of potential derailment of a train.

SUMMARY OF THE INVENTION

In view of the numerous difficulties experienced by present grade crossing structure, it is an object of this invention to provide such a structure that may be installed or removed with minimal disruption of traffic on the thoroughfare and that provides a durable structure capable of supporting the weight of heavy trucks. It is another object of this invention to provide such a structure that may readily be fabricated for use with any number of tracks at such a crossing and for use with a thoroughfare of any desired width. It is yet another object of this invention to provide such a grade crossing structure that may be fabricated easily for either light duty applications or heavy duty applications of continuous traffic of heavy vehicles.

To achieve these and other objects which will become apparent to those skilled in the art, this invention provides the grade crossing structure for use with a paved thoroughfare and a railway, the railway having spaced apart crossties with a lower surface resting upon the railroad bed and upper surfaces facing away from the railroad bed with a pair of rails overlying and supported by the crossties, each such rail having a wheel supporting track with an upper surface facing away from the crossties, an inside surface facing toward the other such rail and an outside surface facing away from the other rail. The rails also include a pair of opposed, lower laterally projecting flanges and a supporting web extending in the center of the rail between the track and the flanges. The grade crossing structure includes a metal rail support plate interposed between each such rail and each such crosstie underlying the grade crossing structure, a decking structure for each such rail and thoroughfare paving materials substantially filling the space between portions of the decking structure. The rail support plate has a substantially flat and horizontal upward facing surface extending outwardly from each such rail flange to an outer edge located a distance equal to at least twice the width of the flange as measured from the center of each rail. The decking structure includes an inner decking element positioned adjacent and extending along the rail track inside surface of one of the pair of rails and an outer decking element positioned adjacent and extending along the rail track outer surface of such one rail. Each decking element comprises a structure having a generally Z-shaped cross section with a lower panel and upper panel generally parallel thereto and joined together by a connector panel. Each lower panel is attached to the upper surface of at least one of the crossties and has a lower surface extending generally parallel to and engaging the crosstie upper surface and an upper surface facing away from that crosstie, with a first edge of the lower panel adjacent the connector panel and positioned adjacent and extending generally parallel to the rail support plate outer edge. Each upper panel of the decking element has a first edge adjacent the connector panel and a second edge spaced from the first edge with both an upper surface extending generally parallel to the rail track upper surface and also a lower surface facing the rail support plate. The upper panel also includes an upper panel support structure extending between the upper panel lower surface and the rail support plate for carrying loads imposed downwardly upon the upper panel to the rail support plate, whereby at least a portion of any downward loads imposed upon the upper panel is carried by the rail support plate and the crosstie carrying the rail support plate. The thoroughfare paving material substantially fills the space between the lower panel upper surface and a plane generally parallel to the upper panel upper surface.

DESCRIPTION OF THE DRAWINGS

A preferred embodiment of the grade crossing structure of this invention will be described in detail below in connection with the illustrations in which.

DESCRIPTION OF A PREFERRED EMBODIMENT

Figure 1:
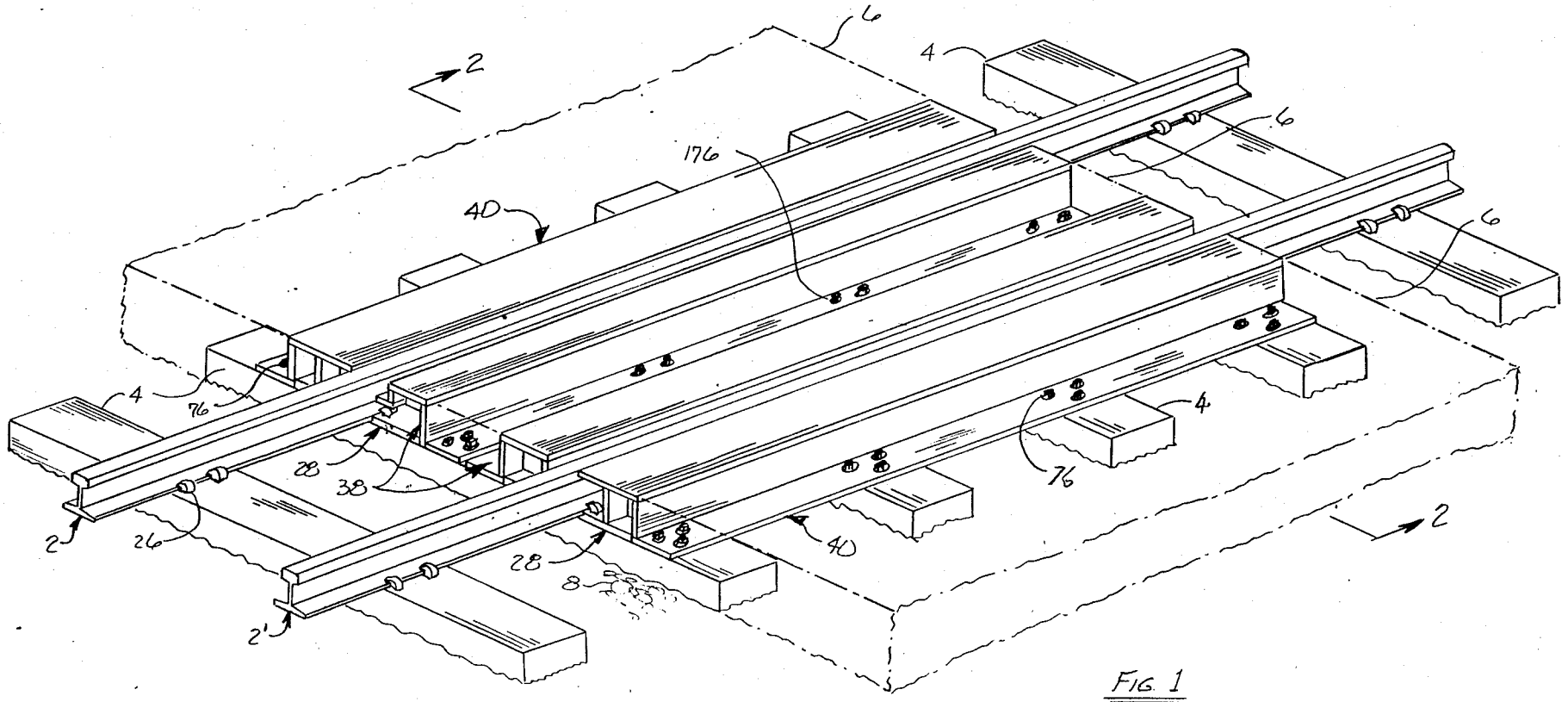
FIG. 1 is an upper perspective view of a grade crossing structure according to the present invention.
Figure 2:
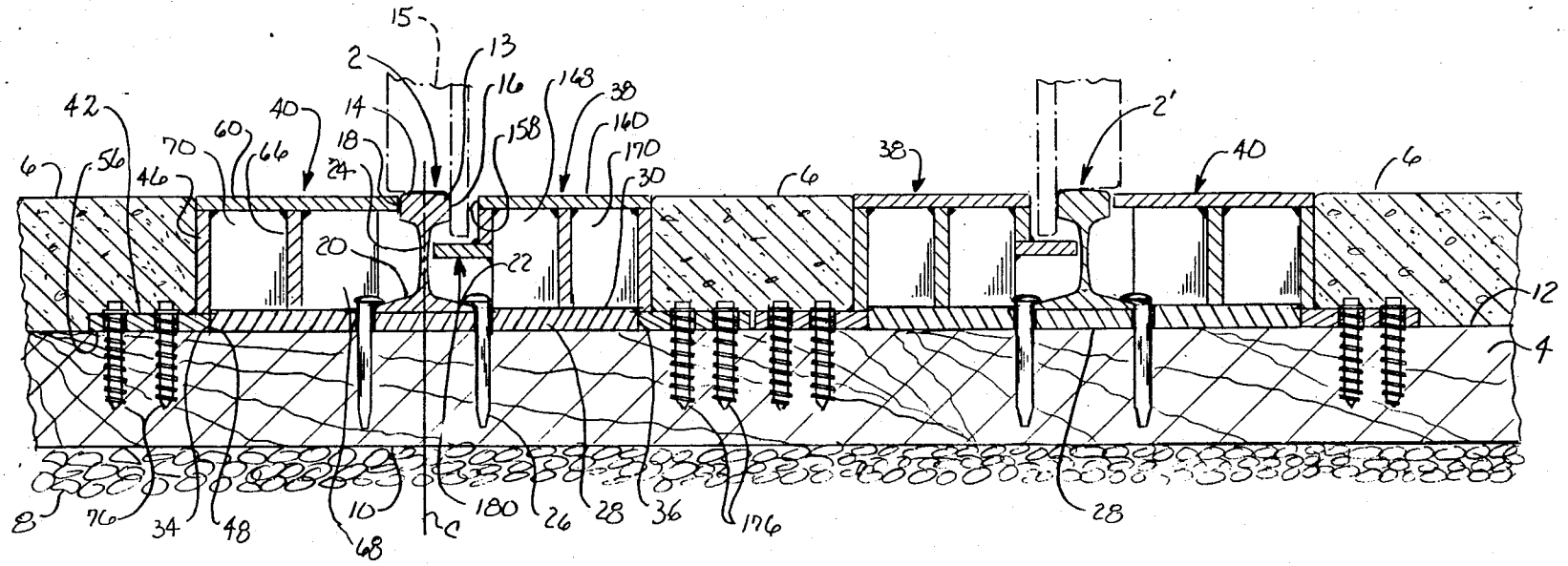
FIG. 2 is a cross-sectional view, taken along line 2—2 of the grade crossing structure of FIG. 1.

A preferred embodiment of the railroad grade crossing structure of this invention is shown in the perspective view of FIG. 1 and the cross sectional view of FIG. 2. In general, the structure is utilized at the intersection of a railway comprising one or more pairs of rails 2 affixed to crossties 4, and a paved vehicular thoroughfare, generally indicated by reference numeral 6. Such thoroughfare paving may be of any conventional material, and may preferably comprise asphalt or a similar substance. The grade crossing structure is interposed between the thoroughfare paving and the rails to provide support for vehicles on the thoroughfare while providing for spacing the thoroughfare paving from the rail.

The detailed structure of this grade crossing is shown most clearly in the cross-sectional view of FIG. 2, taken along lines 2—2 of FIG. 1. This cross-sectional view is intended to be typical of a cross-section taken through the grade crossing structure at any point where the rails are supported by one of the numerous, spaced-apart crossties. Each of the crossties 4 includes a lower surface 10 resting on the roadbed 8, conventionally formed of rock ballast. Each crosstie 4 also includes an upper surface 12 facing away from the roadbed and a pair of rails 2 and 2′ overlying and supported by the crossties. Because the structure for each of the rails 2 and 2′, as well as the grade crossing portions associated with each such rail, are substantially identical, only that structure associated with rail 2 will be described in detail. The structure associated with rail 2′, with each element being numbered correspondingly, is to be understood to be substantially identical to that associated with rail 2.

Each rail 2 includes a wheel-supporting track 13 having an upper surface 14 facing away from the crossties and inside surface 16 facing toward the other rail 2′ and an outside surface 18 facing away from the other rail 2′. Each rail 2 also includes a pair of opposed lower laterally projecting flanges 20 and 22 and a supporting web 24 extending in the center of the rail 2 between the track 13 and the flanges 20 and 22. The rail 2 is anchored to the crosstie by a plurality of spikes 26.

Figure 3:
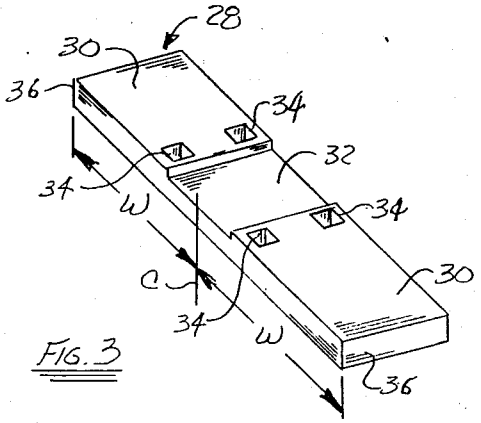
FIG. 3 is a perspective view of a metal rail support plate according to the present invention.

Between the underside of the flanges 20 and 22 of each rail 2 at each crosstie underlying the grade crossing structure is interposed a rail support plate 28, also shown in FIG. 3. This rail support plate is formed of a suitable sturdy metal, such as steel, and includes a substantially flat and horizontal upward facing surface 30. In about the center of this upward facing surface 30 is provided a recess 32 within which are received the flanges 20 and 22 of the rail 2. Appropriate clearance holes 34 are provided through the rail support plate 28 for receiving the spikes 26 that affix the rail to and support plate 28 to the underlying crosstie 4. The upward facing surface 30 of the rail support plate 28 is substantially flat and horizontal when installed as in FIG. 2 and has the recessed portion 32 substantially centered between its lateral edges 34, with center line C indicating the approximate lateral center line of the rail support plate 28 and the supported rail 2. This upward facing surface 30 extends outwardly from the center line C a distance equal to at least twice the width of the respective flange 20 or 22 measured from the center of each rail. Preferably, the rail support plate extends transversely substantially more than twice that rail flange width, as shown in FIGS. 1 and 2.

When the grade crossing structure of this invention is to be installed, such a rail support plate is first installed between each said rail and each said crosstie underlying the grade crossing.

As shown most clearly in FIGS. 1 and 2 this grade crossing structure provides for each rail a decking structure including an inner decking element 38 positioned adjacent and extending along the railroad track inside surface of one of the pair of rails, such as rail 2, and an outer decking element 40 positioned adjacent and extending along the rail track outer surface of that rail. Each of these decking elements, illustrated in greater detail in the perspective views of FIGS. 4 and 5, has a generally Z-shaped cross section. Outer decking element 40 (FIG. 4) comprises a lower panel 42, an upper panel 44 generally parallel to that lower panel and joined to the lower panel 42 by a connector panel 46. The lower panel 42 has a first edge 48 adjacent the connector panel 46 and is joined to that connector panel by suitable means, such as weldment 50. Similarly, upper panel 44 has a first edge 52 adjacent the connector panel 46 and is similarly joined to that connector panel, by suitable means, such as the weldment 54. Preferably, the connector panel 46 extends substantially normal to both the upper panel 44 and the lower panel 42, with all three of these panels being fabricated of substantially rigid metal plate. Such metal plate may suitably be three-quarter inch steel plate, which also may suitably be used for all other portions of the decking elements.

The upper panel 44 of this outer decking member 40 also has a second edge 58 spaced from the first edge 52. This panel also has an upper surface 60 extending generally parallel to the rail track upper surface as shown in FIG. 2 and a lower surface 62 facing the rail support plate 28.

As shown in FIG. 2, the outer decking member 40 is attached to the upper surface of at least one of the crossties 4 at the grade crossing, with the lower surface 56 of the lower panel extending generally parallel to and engaging the upper surface 12 of the crosstie. Also as shown in FIG. 1, the first edge of the outer decking member 40 lower panel 42 is positioned adjacent and generally parallel to, and preferably abutting, the outer edge 34 of the rail support plate 28.

Figure 4:
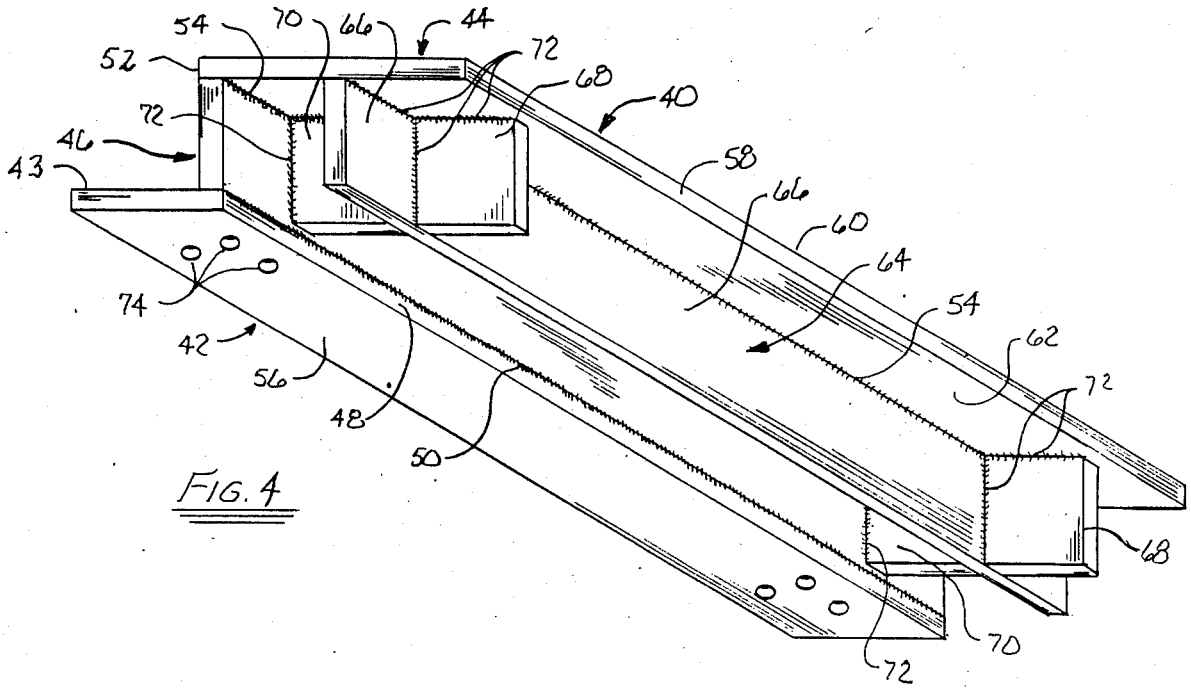
FIG. 4 is a perspective view, taken from the underside, of one of the outer decking elements of the grade crossing structure of FIG. 1.

To support loads impressed upon the upper panel 44, the outer decking element 40 is provided with a support structure generally indicated by the reference number 64 in FIG. 4. This upper panel support structure comprises elongated first support means, suitably in the form of plate 66, extending generally parallel to the upper panel second edge 58 and generally normal to the upper panel lower surface 62, and extending between the upper panel 44 and the rail support plate 28. This support structure 64 thus carries to the rail support plate 28 loads imposed downwardly upon the upper panel 44 of the decking member 40, whereby at least a portion of any downward loads imposed on the upper panel are carried by the rail support plate and the crosstie bearing the rail support plate.

In the preferred embodiment the elongated member 66 comprising the first support means for the upper panel member extends substantially the entire length of the upper panel 44, as measured generally parallel to the upper panel second edge 58. As additional support for the upper panel, this preferred embodiment further includes in its upper panel support structure second support means 68 extending generally normal to the upper panel lower surface 62 and generally normal to the first support means 66. This second support means 68 likewise extends between the upper panel 44 and the rail support plate 28, as shown in FIG. 2. The second support means may further extend, either as an additional portion of the support member 68 extending through the member 66, or as a second member 70, as shown on FIG. 4, from first support member 66 to and engaging the connector panel 46. With this additional portion, such as the member 70, the second support means panel effectively extends from the decking element connector panel 46 to a point below and adjacent the upper panel second edge 58. All of this support structure may suitably be fabricated of a rigid material, such as three-quarter inch steel plate, and may conveniently be affixed to the respective decking panel by conventional means, such as weldments 72. These second support means panels 68 and 70 are preferably positioned to overlie and engage the upper surface 30 of a rail support plate 28, suitably with a plurality of such second support means, each positioned to overlie the spaced rail support plates carried by the crossties. As shown in FIG. 2, this support structure, including panel 66, 68 and 70, while engaging the upper panel lower surface 62 and the rail support plate 28, remains free of engagement with the laterally projecting flanges 20 and 22 or the supporting web 24 of the rail 2, thus avoiding imposition of the downward loads from the decking element directly to any portion of the rail 2.

To affix this decking element 40 in place as shown in FIG. 2, there are provided in the lower panel 42 a plurality of clearance holes 74 through which may be inserted a plurality of fasteners, such as squareheaded drive spikes 76, shown in FIGS. 2. These drive spikes may be screwed into the crosstie, thus holding the decking structure rigidly in place. Preferably, the decking structure is similarly affixed to each of the crossties underlying that decking structure.

Figure 5:
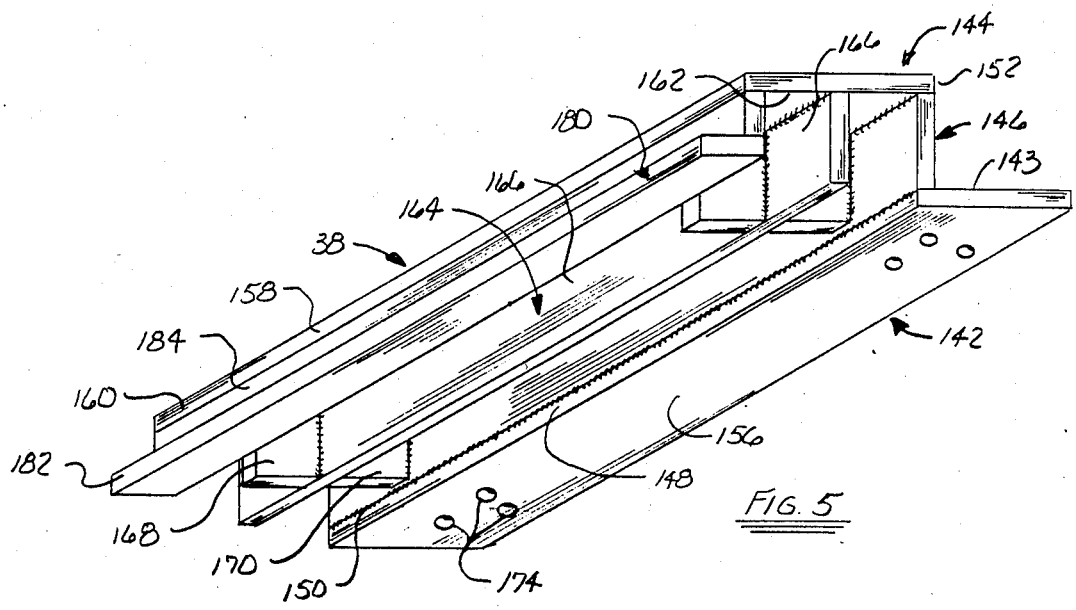
FIG. 5 is a perspective view, taken from the underside, of one of the inner decking elements of the grade crossing structure of FIG. 1.

The inner decking element 38 illustrated most clearly in FIGS. 2 and 5, preferably is substantially similar in most respects to the outer decking element 40, with certain exceptions described below. Accordingly, for simplicity of explanation and ease of reference, the elements of this inner decking member 38 that correspond substantially to those described above with respect to outer decking element 40 are indicated by reference numbers increased by 100, such that element 142 of FIG. 5 corresponds to element 42 of FIG. 4, element 144 of FIG. 5 corresponds to element 44 of FIG. 4, etc.

The primary difference in configuration between the inner decking element 38 and the outer decking element 40 is in the provision of an additional L-shaped member. Whereas the outer decking element upper panel second edge 58 is positioned proximal the rail track outside surface 18, the inner decking element upper panel second edge 158 is spaced from the rail track inside surface a sufficient distance to provide clearance of the flange of the wheels of the train moving along the rail track. Such a train wheel is shown in phantom in FIG. 2 as element 15. This inner decking element 38 further includes a member 180 having a generally L-shaped cross section extending downwardly from the upper panel second edge 158 and outwardly of or away from that decking element toward the rail supporting web 24, as shown in FIG. 2. This L-shaped member suitably includes the horizontally extending portion 182, extending generally parallel to and spaced from the upper panel 144, joined to the underside 162 of that upper panel by the generally vertically extending short connector panel 184. This L-shaped member 180 may suitably be fabricated of rigid metal, such as three quarter inch steel plate, joined by appropriate means, such as weldments, to the upper panel 144. This L-shaped member 180 is provided to fill substantially the gap between the inner decking element upper panel second edge 158 and the adjacent rail 2.

Inner decking element 38 is affixed to the crosstie 2 by appropriate fasteners 176 in the manner corresponding to the method and position of affixation of the outer decking element 40, described above. Such positioning is best illustrated in FIG. 2.

As shown most clearly in FIG. 2, the complete grade crossing comprises, for each pair of rails 2 and 2' supported upon a common set of crossties, a decking structure comprising two such inner decking elements 38 positioned between the rail pair with one each thereof positioned adjacent each rail track inner surface 16, and two such outer decking elements 40 with one each thereof positioned adjacent each such rail track outer surface 18. Because the relative positioning of the inner decking members 38 and outer decking members 40 for a given rail pair are substantially mirror images of one another, the foregoing detailed description is to be understood to apply equally to the decking structure illustrated on the right hand portion of FIG. 2.

After installation of the rail support plates 28, the rails 2 and the decking members 38 and 40 at a desired thoroughfare crossing, the crossing structure is completed by the application of thoroughfare paving material 6 substantially filling the space between the respective lower panel upper surfaces 43 and 143 and a plane generally parallel to the upper panel upper surfaces 60 and 160, as shown in FIG. 2. This thoroughfare paving material, which may suitably be asphalt or other conventional material, provides not only for the smooth transition from the thoroughfare to the decking element upper panels for smooth passage vehicles, but also provides for additional anchoring of the decking elements by overlapping the lower panels.

Whenever it is necessary or desirable to remove the decking elements, all that is required is removal of that portion of the paving material 6 overlying the decking element lower panels 42 and 142 and extraction of the fasteners 76 and 176. While not shown in detail in this preferred embodiment, it is also to be understood that the upper surfaces 44 and 144 of the decking element upper panels 44 and 144 may be grooved, ridged or otherwise textured or roughened to provide for better traction of vehicular tires passing along the thoroughfare and over the grade crossing. Such surface treatment is considered to be conventional and well known to those skilled in the art. Where it is desired to make the crossing structure extremely rigid, the outer ends of the decking member lower panels 42 and 142 and the outer ends of first support members 66 and 166 may be affixed to the rail support plates 28, such as by welding or other means. While this affixation of the decking members to the rail support plates 28 will provide for an extremely rigid structure and is fully within the scope of this invention, such affixation will necessarily complicate any subsequently desired removal of the decking element.

While the foregoing describes a particularly preferred embodiment of the present invention, providing a strong, rugged, yet relatively easily removable and repairable grade crossing structure, it is to be understood that numerous variations and modifications of this structure will readily occur to those skilled in the art. Accordingly, the foregoing description is to be considered illustrative only of the principles of this invention and is not to be considered limitative thereof, the scope of the invention being determined solely by the claims appended hereto.

What is claimed is:

1. A railroad grade crossing structure for use with a paved thoroughfare and a rail roadway having a roadbed, a series of elongated, spaced apart crossties having a lower surface resting upon the roadbed and an upper surface facing away from the roadbed, and a pair of rails overlying and supported by said crossties, each said rail having a wheel supporting track with an upper surface facing away from said crossties, an inside surface facing toward the other said rail and an outside surface facing away from said other rail, a pair of opposed, lower laterally projecting flanges and a supporting web extending in the center of said rail between said track and said flanges, said grade crossing structure comprising a metal rail support plate interposed between each said rail and each said crosstie underlying said grade crossing structure, and rail support plate having a substantially flat and horizontal upward facing surface extending outwardly from each said rail flange to an outer edge located a distance equal to at least twice the width of said flange measured from the center of each said rail;

decking structure for each said rail, said decking structure comprising an inner decking element positioned adjacent and extending along said rail track inside surface of one of said pair of rails and an outer decking element positioned adjacent and extending along said rail track outer surface of said one rail;

each said decking element being formed of substantially rigid metal plate members and comprising a structure having a generally z-shaped cross section and comprising a lower panel and upper panel generally parallel thereto and joined together by a connector panel;

said lower panel being attached to the upper surface of a plurality of said crossties and having a lower surface extending generally parallel to and engaging said upper surfaces of said crossties and an upper surface facing away from said crossties, with a first edge of said lower panel adjacent said connector panel and extending generally parallel to and in abutting engagement with said outer edges of a plurality of said rail support plates such that the combination of said affixation to said crossties and said rail support plate engagement will serve to hold said decking structure rigidly in place relative to said rails;

said upper panel having a first edge adjacent said connector panel and a second edge spaced from said first edge and having both an upper surface extending generally coplaner with said rail track upper surface and also a lower surface facing said rail support plate, with an upper panel support structure extending between and engaging said upper panel lower surface and said rail support plate, while remaining free of engagement with said rail flanges and said rail supporting web, for carrying loads imposed downwardly upon said upper panel to said rail support plate, whereby at least a portion of any downward loads imposed upon the upper panel is carried by the rail support plate and a crossstie bearing the rail support plate with substantially none of such upper panel downward loads being borne by any portion of the rail; and thoroughfare paving material substantially filling the space between said lower panel upper surface and a plane generally parallel to said upper panel upper surface.

2. The grade crossing structure of claim 1 wherein said decking element connector panel extends normal to both said upper panel and said lower panel.

3. The grade crossing of claim 1 wherein said outer decking element upper panel second edge is positioned proximal to said rail track outside surface and said inner decking element upper panel second edge is spaced from said rail track inside surface a distance sufficient to provide clearance of the flanges of the wheels of a train moving along said rail track and wherein said inner decking element further includes a member having a generally L-shaped cross section extending downwardly from said upper panel second edge and outwardly of said decking element toward said rail supporting web, whereby the L-shaped member serves to fill substantially the gap between the inner decking element upper panel second edge and its adjacent rail.

4. The grade crossing of either claims 1 or 3 wherein said crossing comprises for each pair of rails supported upon a common set of crossties a decking structure comprising two said inner decking elements positioned between said rail pair with one each thereof positioned adjacent each said rail track inner surface, and two said outer decking elements with one each thereof positioned adjacent each said rail track outer surface.

5. The grade crossing structure of claim 1 wherein said upper panel support structure comprises elongated first support means extending generally parallel to said upper panel second edge and generally normal to said upper panel lower surface between said upper panel and said rail support plate.

6. The grade crossing of claim 5 wherein said first support means extends for substantially the entire length of said upper panel measured parallel to said upper panel second edge.

7. The grade crossing of claim 6 wherein said decking structure extends alongside said rail a distance generally equal to the width of the thoroughfare crossing said rail.

8. The grade crossing of claim 5 wherein said upper panel support structure further comprises second support means extending generally normal to said upper panel lower surface between said upper panel and said rail support plate and generally normal to said first support means.

9. The grade crossing of claim 8 wherein said second support means comprises panel means extending generally normal to said decking element connector panel.

10. The grade crossing of claim 9 wherein said second support means panel extends from said decking element connector panel to a point below and adjacent said upper panel second edge.

* * * * *